US009068354B2

(12) United States Patent
Railkar

(10) Patent No.: US 9,068,354 B2
(45) Date of Patent: Jun. 30, 2015

(54) CORNER PATCHES AND METHODS FOR TPO ROOFING

(75) Inventor: Sudhir Railkar, Wayne, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 596 days.

(21) Appl. No.: 13/454,674

(22) Filed: Apr. 24, 2012

(65) Prior Publication Data

US 2012/0216474 A1 Aug. 30, 2012

Related U.S. Application Data

(63) Continuation-in-part of application No. 12/351,218, filed on Jan. 9, 2009, now Pat. No. 8,161,688.

(51) Int. Cl.

| | |
|---|---|
| ***E04D 1/36*** | (2006.01) |
| ***E04D 13/147*** | (2006.01) |
| ***E04D 3/38*** | (2006.01) |
| ***E04D 13/14*** | (2006.01) |

(52) U.S. Cl.

CPC ..... *E04D 13/1475* (2013.01); *E04D 3/38* (2013.01); *E04D 13/1478* (2013.01); *E04D 1/36* (2013.01); *E04D 13/1407* (2013.01); *Y10T 428/21* (2015.01); *Y10T 428/24446* (2015.01)

(58) Field of Classification Search

CPC ... E04D 13/1407; E04D 13/1478; E04D 3/38; E04D 1/36; E04D 1/66; E04D 13/1475; Y10T 428/21; Y10T 428/2446

USPC ..... 52/58, 219, 287.1, 408

See application file for complete search history.

(56) References Cited

U.S. PATENT DOCUMENTS

| | | | | | |
|---|---|---|---|---|---|
| 3,325,953 | A | * | 6/1967 | Alleaume | 52/276 |
| 4,330,581 | A | * | 5/1982 | Borgert et al. | 428/66.4 |
| 4,462,190 | A | * | 7/1984 | Allen | 52/58 |
| 4,598,505 | A | * | 7/1986 | McGown | 52/58 |
| 4,603,517 | A | * | 8/1986 | Lyons, Jr. | 52/60 |
| 4,635,409 | A | * | 1/1987 | Vandemore | 52/60 |
| 4,781,008 | A | * | 11/1988 | Lyons, Jr. | 52/656.1 |
| 4,799,986 | A | * | 1/1989 | Janni | 156/196 |
| 4,872,296 | A | * | 10/1989 | Janni | 52/58 |
| 4,969,250 | A | * | 11/1990 | Hickman et al. | 29/521 |
| 5,072,552 | A | * | 12/1991 | Sauder | 52/58 |
| 5,077,943 | A | * | 1/1992 | McGady | 52/58 |
| 5,414,964 | A | * | 5/1995 | Bodycomb | 52/58 |
| 5,581,959 | A | * | 12/1996 | Occhipinti | 52/58 |
| 5,706,610 | A | * | 1/1998 | Mayle | 52/60 |
| D400,080 | S | * | 10/1998 | Beard, Jr. | D8/354 |
| 5,896,711 | A | * | 4/1999 | McClure | 52/200 |

(Continued)

*Primary Examiner* — Basil Katcheves
*Assistant Examiner* — Joshua Ihezie
(74) *Attorney, Agent, or Firm* — Womble Carlyle Sandridge & Rice LLP

(57) ABSTRACT

An outside corner patch for TPO roofing is formed from a circular piece of TPO membrane material being vacuum formed to define an array of flutes that extend from the center of the piece toward its edges. The flutes form ridges and valleys that generally are shaped as conical sections with the apex of the conical sections located at the center of the patch. The number and size of the flutes is optimized in such a way that, when the flutes are stretched flat, the patch conforms to and fits flat against the surfaces of an outside corner formed by the intersection of a roof deck with an upward protrusion from the roof. The TPO outside corner patch is applied over the corner and thermally welded to surrounding TPO membranes on the roof deck and the protrusion to form a watertight seal at the outside corner.

12 Claims, 8 Drawing Sheets

(56) References Cited

U.S. PATENT DOCUMENTS

| | | | | |
|---|---|---|---|---|
| 5,983,592 | A * | 11/1999 | Mayle | 52/746.11 |
| 6,070,370 | A * | 6/2000 | Locke | 52/58 |
| 6,122,874 | A * | 9/2000 | Smerilli | 52/408 |
| 6,199,326 | B1 * | 3/2001 | Mayle | 52/58 |
| 6,457,279 | B1 * | 10/2002 | Jacobsen et al. | 52/58 |
| 6,681,530 | B1 * | 1/2004 | Givens | 52/58 |
| 6,715,237 | B2 * | 4/2004 | Batt, Sr. | 52/11 |
| 6,754,993 | B1 * | 6/2004 | Mayle et al. | 52/58 |
| 6,892,782 | B1 * | 5/2005 | Mayle | 156/581 |
| 7,168,211 | B2 * | 1/2007 | Prenn et al. | 52/200 |
| 7,373,729 | B2 * | 5/2008 | Mossot et al. | 33/527 |
| 7,638,180 | B2 | 12/2009 | Nebesnak | |
| 8,161,688 | B2 * | 4/2012 | Railkar | 52/58 |
| 2003/0150175 | A1 * | 8/2003 | Rillie | 52/200 |
| 2004/0074156 | A1 * | 4/2004 | Haynes | 52/58 |
| 2005/0055889 | A1 * | 3/2005 | Thaler | 52/58 |
| 2005/0166471 | A1 * | 8/2005 | Allen | 52/58 |
| 2005/0268561 | A1 * | 12/2005 | Lane et al. | 52/58 |
| 2006/0053699 | A1 * | 3/2006 | Lolley et al. | 52/58 |
| 2006/0130411 | A1 * | 6/2006 | Edgar et al. | 52/58 |
| 2009/0090068 | A1 * | 4/2009 | O'rourke | 52/58 |
| 2009/0277102 | A1 * | 11/2009 | Bishop et al. | 52/58 |
| 2012/0180402 | A1 * | 7/2012 | Kalwara et al. | 52/58 |

* cited by examiner

CORNER PATCHES AND METHODS FOR TPO ROOFING

REFERENCE TO RELATED APPLICATION

This is a continuation-in-part of U.S. patent application Ser. No. 12/351,218 filed on 9 Jan. 2009, now U.S. Pat. No. 8,161,688.

TECHNICAL FIELD

This disclosure relates generally to thermoplastic polyolefin (TPO) membrane roofing materials and methods and more particularly to TPO outside corner patches for sealing around vents and other structures that protrude from a roof structure.

BACKGROUND

It is common for commercial and other roofs that are substantially flat to seal the roof with a waterproof membrane such as polymer coated membranes, more commonly referred to as thermoplastic polyolefin membranes or simple TPO membranes. Almost all such roofs include various protrusions that project upwardly from the roof deck such as, for instance, vents, ductwork, air conditioning units, and the like. Providing a water-tight seal around such protrusions, and particularly where the corners of a protrusion meet the flat roof deck, can be a challenge. More specifically, it is possible to wrap the protrusion at least partially with a skirt of TPO membrane with the bottom edge portion of the skirt flaring out to cover and be heat sealed to the roof membrane. However, this requires that the skirt be slit at the bottom of the corners of the protrusion, which leaves a region where the corners meet the flat roof unsealed and subject to leaks.

Corner pieces made from TPO have been developed to address this problem. For example, the Firestone® ReflexEON® inside/outside corner patch is a molded piece of TPO plastic with the general shape of a right angle corner permanently molded in. The molded corner is placed around the bottom corner of a protrusion and the patch is heat sealed to the surrounding TPO membranes to seal the corner. In contrast, GenFlex®TPO reinforced outside corners are factory fabricated corners made from high performance TPO roofing membrane. These are generally made by slitting a square piece of TPO membrane from its center to a corner and then spreading the membrane out at the slit to cause the opposite corner to form a loose pleat. The gap between the spread edges of the slit is then filled in with another piece of TPO membrane, which is heat sealed in place to form a unitary corner patch. In use, the loose pleat is applied around the bottom corner of a protrusion and the patch is heat sealed to surrounding TPO membranes on the roof and the protrusion to form a water-tight seal.

Other examples of attempted solutions can be found in U.S. Pat. Nos. 4,700,512; 4,799,986; 4,872,296; and 5,706,610. It also has been common in the past for installers of membrane roofs to custom make their own corner patches on-site by heating, stretching, cutting, and otherwise manipulating small pieces of TPO membrane. Corner patches and other solutions in the past have not been entirely satisfactory for a number of reasons including that they do not fit well around corners, they must be "bunched up" to fit a corner properly, thus jeopardizing the ability for form a reliable seal, and/or they contain heat sealed joints that can fail and result in a leak. There is a need for a corner patch that addresses satisfactorily the shortcomings and problems of the prior art.

SUMMARY

Briefly described, a patch is disclosed for flat TPO sealed roofs that seals the outside bottom corners of roof protrusions such as vents, ductwork, air conditioning units, where the corners meet the flat roof. In one embodiment, the patch is made of a circular blank of TPO material that is vacuum formed to produce a plurality of radially extending flutes or peaks and valleys in the patch. This is referred to herein as a daisy wheel configuration. The number of flutes, the depth of each flute, and the radius of the blank are optimized according to methods of the invention so that the patch fits an outside bottom corner of a roof protrusion perfectly or near perfectly when the flutes are spread out. The patch can then be heat sealed to surrounding TPO membranes on the protrusion and the roof to provide a water-tight seal where corners of protrusions meet the flat roof. The TPO daisy wheel corner patch of this disclosure also can be optimized for corners that are not orthogonal; i.e. where the sides of the protrusion and the roof do not form right angles with respect to each other. This has not generally been possible with prior art prefabricated corners and has required tedious custom fabricating of corner patches on sight for acceptable results. The patch of this invention also is easily and efficiently packaged because the daisy wheel shape of the patches allows them to be nested together in a compact stack.

Thus, an improved prefabricated TPO corner patch is now provided that fits a corner for which it is designed perfectly to provide a reliable water-tight seal, that is compact and efficient to stack, store, and transport, and that can be optimized for orthogonal and other outside corner shapes commonly encountered in flat or semi-flat commercial roofs. These and other aspects, features, and advantages will be better understood upon review of the detailed description set forth below when taken in conjunction with the accompanying drawing figures, which are briefly described as follows.

DETAILED DESCRIPTION

Figure 1:
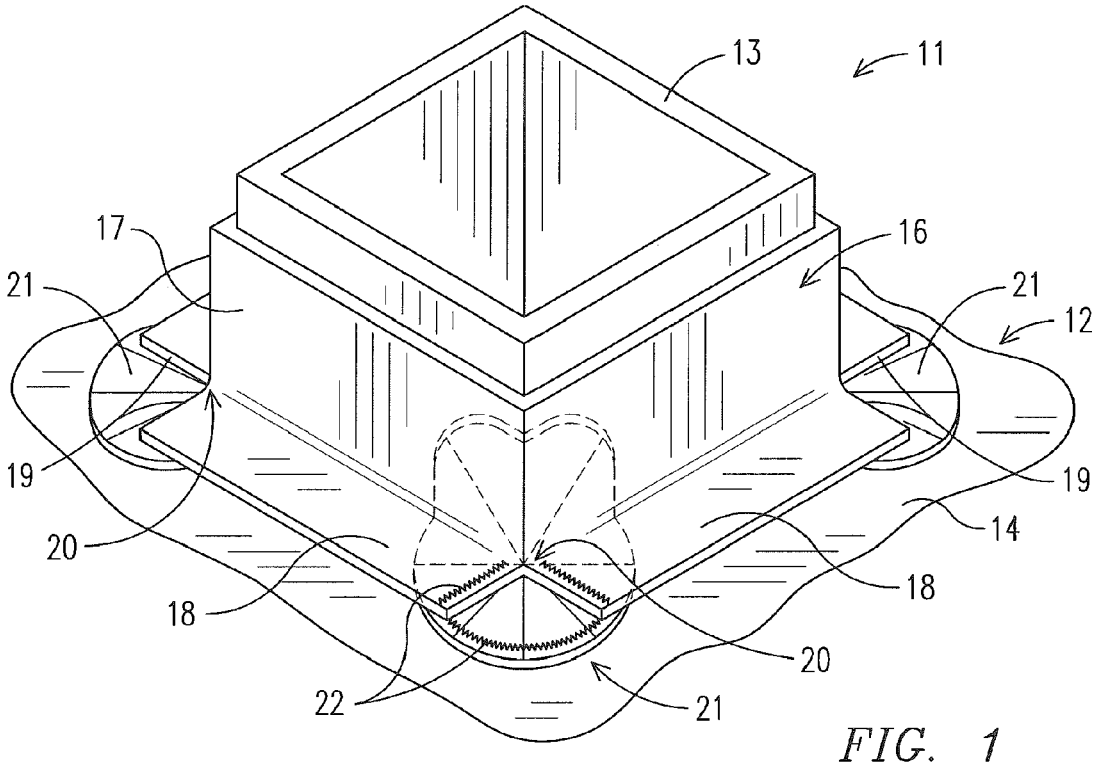
FIG. 1 is a perspective view of a section of a flat TPO sealed roof with a protrusion and illustrates one preferred application of the TPO outside corner patch.

Referring now in more detail to the drawing figures, wherein like reference numerals indicate like parts throughout the several views, FIG. 1 illustrates a section 11 of a flat roof having a protrusion 13. The protrusion is illustrated as a generic square upward projection from the roof deck. In reality, such projections take many forms and protrusion 13 may represent, for example, a chimney, a vent pipe, a duct, and air conditioning platform or unit, or otherwise. In any event, the protrusion 13 and the flat roof deck form outside corners 20 where the corners of the protrusion meet the roof deck. In the illustrated embodiment, the outside corners 20 are orthogonal; that is, the faces of the protrusion and the roof deck all meet at approximately right angles. However, the outside corner patch of this disclosure is not limited to use with orthogonal outside corners but may be optimized for non-orthogonal outside corners.

The flat portion of the roof 11 is covered and sealed with a TPO membrane 14 as is known in the roofing art to prevent water from leaking into the building below. A cutout (not visible) is formed in the membrane at the location of the protrusion and the peripheral edges of the cutout extend up to the bottom of the protrusion. In order to seal along these bottom edges, a skirt or apron 16 of TPO membrane material is wrapped around and sealed to the protrusion 13 with the bottom of the skirt 16 flaring out to overly the membrane 14. More particularly, the skirt 16, when installed, includes an upper portion 17 that covers at least the lower section of the protrusion and flaps 18 that flare outwardly to overly and cover the membrane 14, to which the flaps 18 are thermally welded to form a watertight seal. In order to allow the flaps 18 to extend outwardly, the TPO membrane forming the skirt 16 is slit during installation at the bottom corners of the protrusion, as indicated by reference numeral 19. This leaves an outside corner 20 where the corners of the protrusion and the end of the slit meet the roof deck that is subject to leaks unless properly sealed. Outside corner patches 21 according to the present disclosure are applied to seal these outside corners 20, as detailed below.

An outside corner patch 21 according to the present disclosure is applied at each of the outside corners 20 of the protrusion to form a watertight seal at these corners. Referring to the foreground outside corner in FIG. 1, the outside corner patch 21 comprises a specially formed circular piece of TPO membrane material that has been fluted, as detailed below, to conform to the shape of the outside corner when the patch is spread out. In this illustration, the corner patch 21 is applied beneath the upper portion 17 of the skirt and beneath the two adjacent flaps 18. It will be understood, however, that the patch also may be applied over the top of the upper portion 17 of the skirt and over the top of the two adjacent flaps 18 if desired. In either event, the corner patch 21 is thermally welded to the TPO material of the skirt 16 and the roof membrane 14, as indicated at 22, thus forming a watertight seal at the bottom outside corner of the protrusion. Thermal welding or heat sealing of TPO corners and other members to membranes is well known in the commercial roofing trade and thus the details of this process need not be discussed in detail here.

Figure 2:
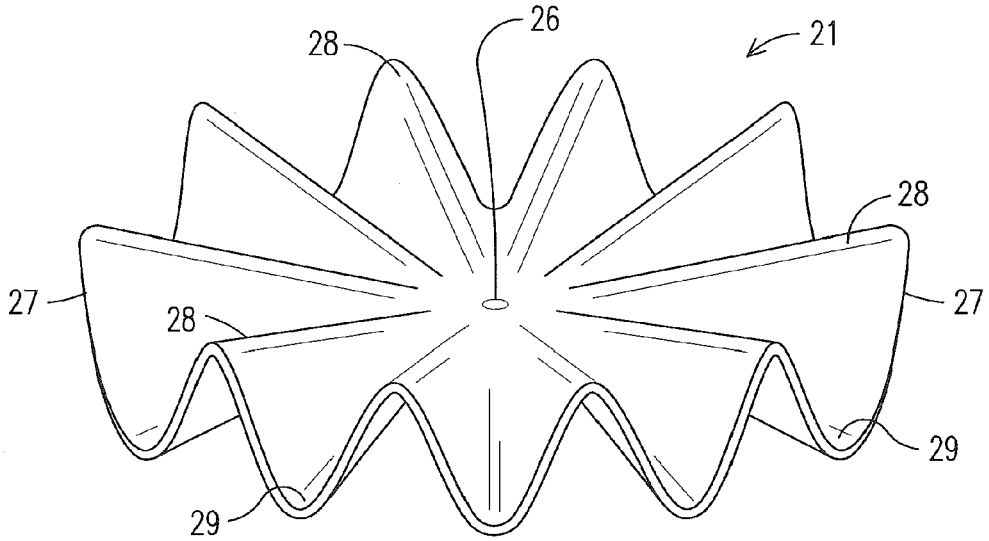
FIG. 2 is a perspective view of a TPO outside corner patch that embodies principles of the disclosure in a preferred form.

FIG. 2 illustrates a preferred configuration of the outside corner patch of this disclosure before being applied to the outside corner of a protrusion, as illustrated in FIG. 1. The patch 21 is generally circular in shape with a central region 26 and a periphery 27 and is radially fluted to define an array of radially extending peaks 28 and corresponding radially extending valleys 29. This forms the daisy wheel configuration of the patch. The peaks and valleys expand in amplitude from substantially zero amplitude at the central region 26 of the patch to a maximum amplitude at the periphery 27 of the patch. The patch 21 can be fabricated in a variety of ways. Preferably, however, a circular cutout of standard TPO membrane material is heated and vacuum formed to generate the daisy wheel configuration with a predetermined number of peaks and valleys. Other possible fabrication methods might include injection molding, thermoforming, pressure molding, or similar known techniques. The patch shown in FIG. 2 is illustrated with 10 peaks and 10 valleys defining the daisy wheel configuration. However fewer or more peaks and valleys might be selected based upon the optimization techniques described in detail below.

For installation of the outside corner patch of this disclosure, the patch is positioned with its central region 26 aligned with and covering the corner where the faces of the protrusion meet the flat roof. The flutes of the patch are then spread out substantially flat as the patch is conformed to the contour of the outside corner. More specifically, the flutes are spread out until the patch lies flat against both of the faces of the protrusion and also lies flat against the flat roofing membrane in the region of the corner. With the number of flutes and the sizes of the flutes optimized for the three dimensional shape of the outside corner, the patch conforms near perfectly to the faces of the protrusion and the roof when fully spread out. The patch can then be thermally welded or heat sealed to the underlying or overlying, as the case may be, TPO material of the upper portion 17 of the skirt, the flaps 18, and the roof membrane 14 thus forming a watertight seal at the outside corner of the protrusion.

Figure 3:
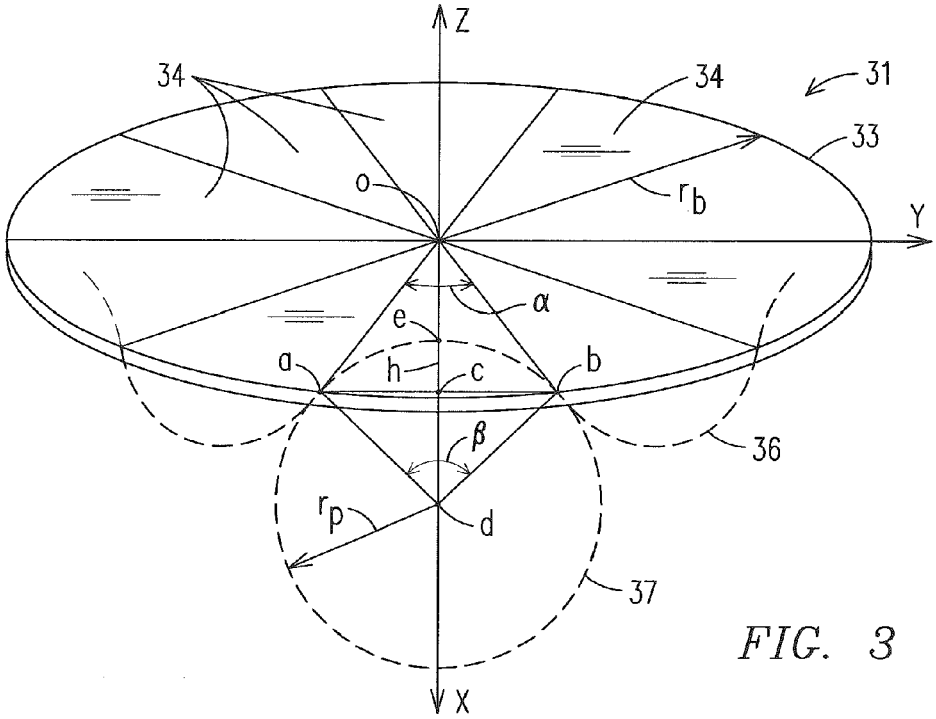
FIG. 3 a perspective view of a circular TPO blank from which the corner patch of this disclosure is molded illustrating design variables for optimizing the number and depth of flutes for a particular corner.

As mentioned above, in order for the outside corner patch of this disclosure to conform to an outside corner, its configuration, i.e. the number and sizes of the flutes should be optimized for the shape of the outside corner and the diameter of the patch. Most outside corners are orthogonal, but the patch may also be optimized for non-orthogonal outside corners if desired. The optimization methodology described immediately below is for an orthogonal outside corner. FIG. 3 illustrates the design variables that enter into the optimization process. The starting circular blank of TPO material 31 from which the patch is to be formed has a center O, a periphery 33 and can be divided into pie-shaped sections 34, each of which will be deformed into a generally cone-shaped peak or a valley of the final fluted patch, as illustrated by phantom line 36. An imaginary plunge circle 37 may be constructed as an aid in deriving the optimization algorithms. The variables shown in FIG. 3 that are relevant to the optimization process of this invention are defined as follows.

n: number of flutes (total of peaks plus valleys)

$r_b$: radius of circular TPO blank $r_p$: radius of plunge circle

α: flute blank angle h: depth of draw

β: flute depth angle a, b, c, d, and e identify various useful points on the construction With these optimization variables identified, and with reference to FIG. 3, we see that for triangle oac:

$$\sin(\alpha/2)=ab/2/oa=ab/2/r_b$$

$$\text{Thus: } ab=2r_b\sin(\alpha/2) \quad (1)$$

$$\text{where: } \alpha=2\pi/n \quad (2)$$

Assume that a plunge circle will generate arc aeb when the flat blank is deformed so that the edge of the flute conforms to the plunge circle. Then, for triangle acd, we can see from the Pythagorean Theorem for right triangles that:

$$ad^2=ac^2+cd^2$$

$$\text{or: } r_p^2=(ab/2)^2+cd^2 \text{ but } cd+h=r_p$$

$$\text{so: } r_p^2=(ab/2)^2+(rp-h)^2$$

solving this equation for $r_p$ gives:

$$r_p=((ab)^2/4+h^2)/2h \quad (3)$$

$$\text{and: } \sin(\beta/2)=bc/db=ab/2/r_p$$

$$\text{so that: } \beta=2\sin^{-1}(ab/2r_p) \quad (4)$$

Hence, for a given depth of draw "h," the plunge circle radius $r_p$ can be calculated from equation 3. Then, the plunge circle circumference is:

$$2\pi r_p$$

and the length of the flute edge that will follow the contour of the plunge circle when the blank is deformed is:

$$\beta/2\pi\times 2\pi r_p \text{ or just } \beta r_p$$

Finally, the total length of the perimeter edge of a fluted patch with n flutes, which we shall designate the "fluted circumference" or $c_f$, is given by the total of the lengths of each individual flute, or:

$$c_f=n\beta r_p \quad (5)$$

Now, referring to FIG. 4, which shows a fluted circular patch stretched flat and conformed to an outside orthogonal corner, and considering that the radius of the fluted patch is equal to the radius of the blank $r_b$, we can determine, using the equation below, the total length of the perimeter of a fluted patch required for the patch to conform to the orthogonal corner. We shall call this perimeter length the "design circumference" or simply the "target."

$$(2\pi r_f)+\tfrac{1}{4}(2\pi r_b)=5/4(2\pi r_b) \quad (6)$$

Figure 4:
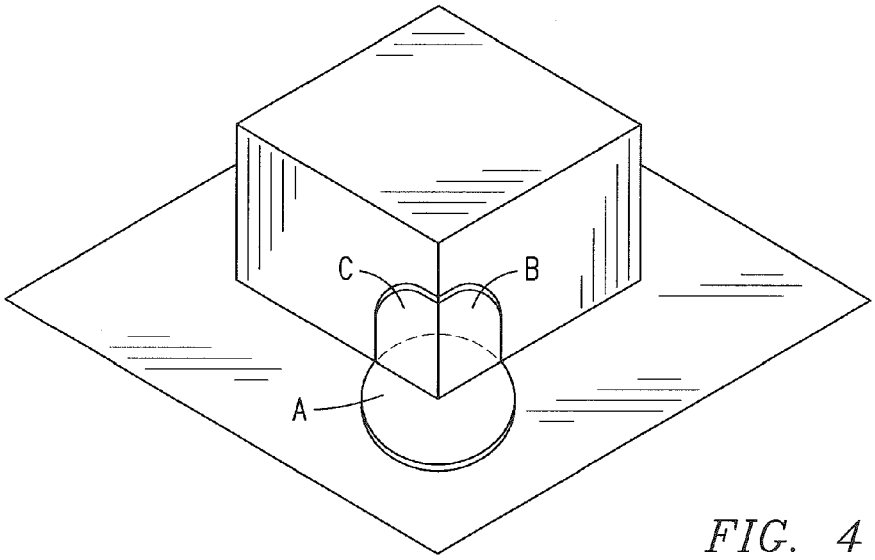
FIG. 4 shows a generic protrusion with a corner patch and illustrates how a design circumference is determined for a patch of a give radius.

The design circumference also can be derived by considering that A in FIG. 4 is ¾ of a circle while B and C are each ¼ of a circle. Adding the circumferences of each of these partial circles gives:

$$\tfrac{3}{4}(2\pi r_b)+\tfrac{1}{4}(2\pi r_b)+\tfrac{1}{4}(2\pi r_b)=5/4(2\pi r_b)$$

Figure 5:
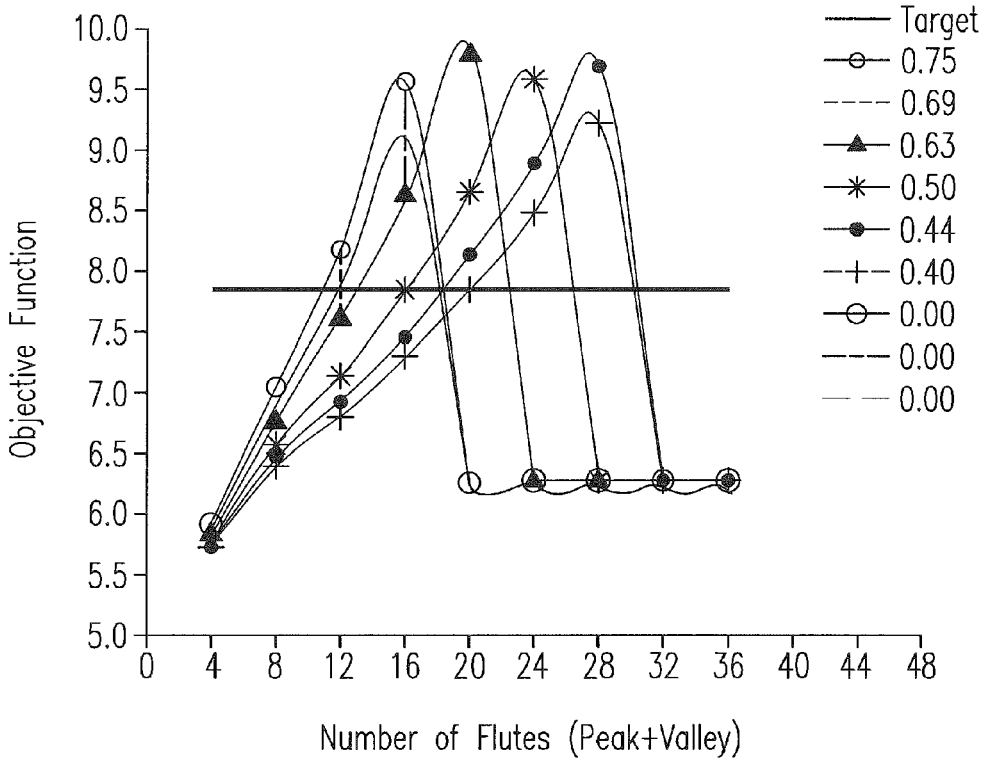
FIG. 5 is a graph illustrating the results of the optimization methodology of the present disclosure.

Hence, optimization routines can be run for a blank of a given radius by selecting various values of flute draw h and, for each value of h, varying the number of flutes n until the combination of h and n generate a fluted circumference $c_f$ that is equal or very close to the design circumference given by equation 6. FIG. 5 illustrates, in the form of a graph, the results of such an iteration to determine the optimum combination of flutes n and flute draw h required for a corner patch having a 4 inch diameter radius to conform perfectly to an outside orthogonal corner. The design circumference or target calculated from equation 6 is represented by the dark horizontal line on the graph. Each curve of the graph represents the fluted circumference $c_f$ for one of the flute draw values shown in the box at the upper right of the graph for various values of the number of flutes n. It will be noted that only the data points on each graph represent a realistic combination of h and n since n must be an even integer.

It can be seen from FIG. 5 that the following combinations of number of flutes n and flute draw h generate, for a four inch radius blank, a fluted circumference that is very close the design circumference:

n=12 and h=0.69 inch n=16 and h=0.5 inch and n=20 and h=0.4 inch

Either of these combinations would result in a fluted patch that would conform to an outside orthogonal corner when stretched out flat. However, due to manufacturing considerations, and to produce a relatively rigid and robust final product, the first combination of n=12 and h=0.69 is considered most optimal.

A four inch radius TPO blank was formed according to the above optimization methodology with 12 flutes and a flute draw of 0.69 inches and was tested on an orthogonal outside corner of a protrusion. The test patch proved to conform near perfectly to the corner when placed with its center directly at the corner and its flutes stretched out flat to cover the deck and contiguous sides of the protrusion. Of course, patches of radii other than 4 inches such as, for instance, 2, 6, or 8 inches, can be optimized according to the forgoing methodology so that the radius of the starting TPO blank is not a limitation of the methodology or the invention.

Figure 6:
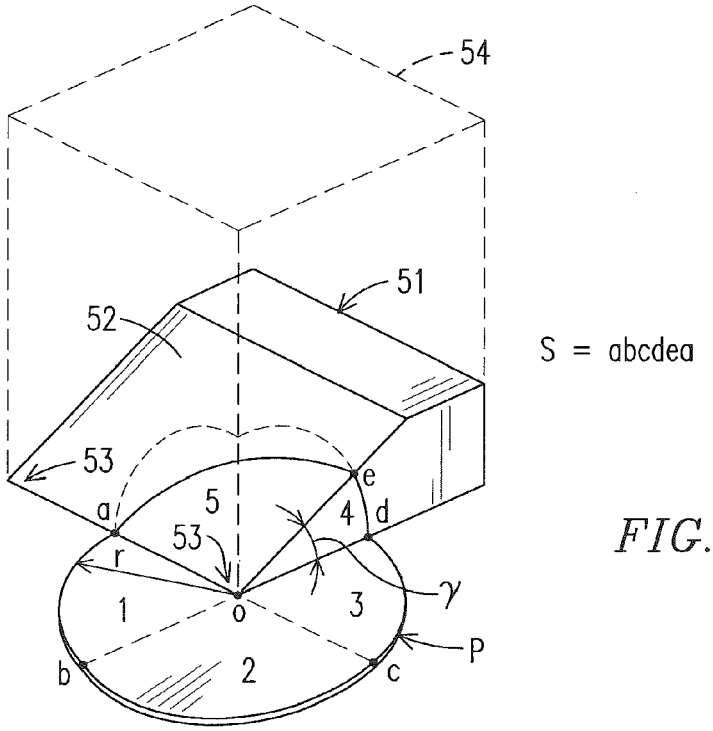
FIG. 6 illustrates the variables involved when designing an outside corner patch for a non-orthogonal protrusion, in this case a wedge-shaped protrusion on a flat roof.

The considerations are similar when designing an outside corner patch that fits near perfectly over an outside corner that is not orthogonal. FIG. 6 illustrates such a situation. Here, a roof protrusion 51 has an angled face 52 that defines two non-orthogonal corners 53 where the angled face meets the roof deck. More specifically, the corners 53 are wedge-shaped from the side and extend upwardly from the roof deck at an acute angle γ with respect to the roof deck. The shape of a protrusion with orthogonal corners is shown in phantom line and identified with reference numeral 54 as a relative comparison.

The outline P of a corner patch that fits the acute angle wedge-shaped corner is shown in FIG. 6 with various identifying markings that are involved in calculations when optimizing a corner patch to fit the non-orthogonal corner defined by angle γ. Specifically, strategic points around the circumference of the outline are identified as a, b, c, d, and e and sections of the outline defined by these points are identified as sections 1, 2, 3, 4, and 5. It will be seen then that the total circumference S of the outline P (and thus the required circumference of a flattened corner patch designed to fit the corner) is ab+bc+cd+de+ea.

It can be seen from FIG. 6 that sections 1, 2, 3, and 5 of the outline P each consists of one quarter of a circle, or πr/2. However, unlike the example above for an orthogonal corner, section 4 extends for less than a quarter of a circle and specifically extends for angle γ up the wedge-shaped side of the protrusion. Thus, the length L of segment de can be calculated by the following equation:

$$L=ry \quad (7)$$

where the angle γ is expressed in radians. Accordingly, the total circumference S needed to fit a corner patch to the non-orthogonal corner shown in FIG. 6 is given by:

$$S=ab+bc+cd+de+ea$$

$$S=\pi r/2+\pi r/2+\pi r/2+\gamma r+\pi r/2$$

$$S=4\pi r/2+\gamma r$$

$$S=2\pi r+\gamma r \quad (8)$$

Where γr is the length of the "extra arc" needed to span the wedge shaped side of the protrusion. In the special case of an orthogonal outside corner, then $\gamma=\pi r/2$ and the total circumference is $4/4(2\pi r)+\pi r/2=4/4(2\pi r)+\frac{1}{4}(2\pi r)=5/4(2\pi r)$, the results obtained in equation (6) above for an orthogonal outside corner. Equation 8, then, is the generalized equation for the design or target conference of a corner patch for a protrusion having a non-orthogonal wedge-shaped corner, such as that of FIG. 6.

Having determined a design circumference according to equation (8), this design circumference can be substituted into the fluting equations and optimized through itteratation as described above for various values of flute draw h and number of flutes n. The optimization methodology is the same as with the special case of an orthogonal outside corner. The result is outside corner patch with the optimized number of flutes and flute draw that, when flattened, will fit the non-orthogonal corner near perfectly. Following are examples of this process for an acute angle outside corner such as that shown in FIG. 6 as well as outside corners defined by other angles.

EXAMPLES

Figure 7A:
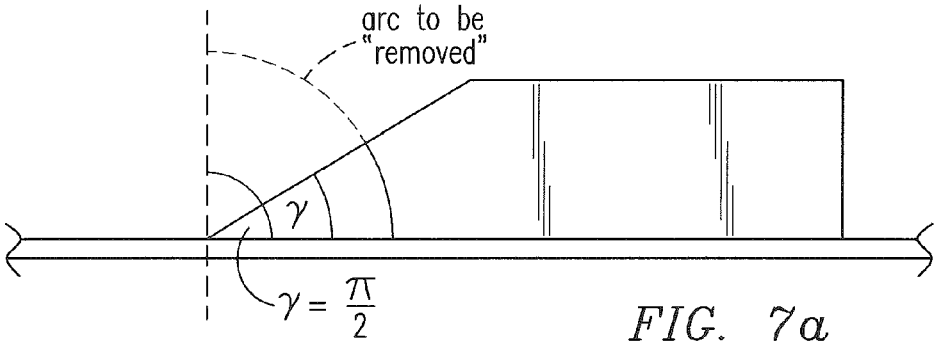
FIG. 7*a* is a side elevational view of a non-orthogonal roof protrusion forming an acute angle at two of its corners.
Figure 7B:
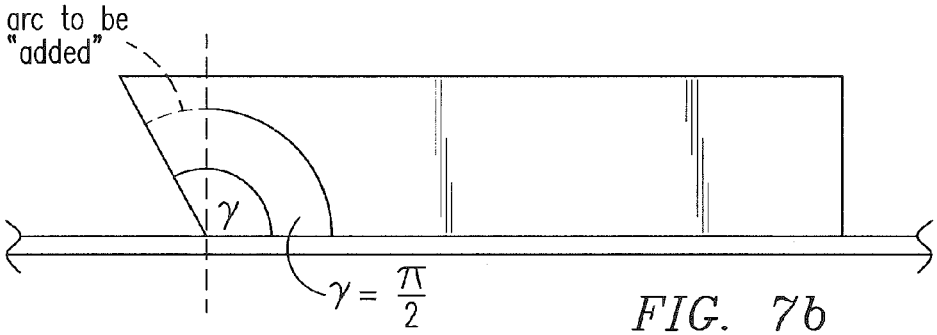
FIG. 7*b* is a side elevational view of a non-orthogonal roof protrusion forming an obtuse angle at two of its corners.

The following examples are better understood with reference to FIGS. 7*a* and 7*b*, which show a non-orthogonal outside corner with an acute angle and a non orthogonal outside corner with an obtuse angle respectively.

1. When γ=0 (corresponding to a flat surface), then the generalized design circumference is give by equation (8) as $2\pi r+0=2\pi r$, the circumference of an ordinary circle. Obviously, no patch is required to fit a flat surface.

2. When $\gamma=\pi/2$ (90 degrees), corresponding to an orthogonal outside corner, then the design circumference given be equation (8) is $5/4(2\pi r)$ as we have seen above.

3. When γ is an acute angle, say π/4 (corresponding to a 45 degree angle), then the design conference given by equation (8) is $2\pi r+\pi r/4=9/8(2\pi r)$. This can also be expressed as $2\pi r+\frac{1}{4}(2\pi r)-\frac{1}{8}(2\pi r)$, where the last term represents the length of an orthogonal optimized arc that must be "removed" to fit an outside corner with a 45 degree angle. This is indicated by the term "arc to be removed" in FIG. 7*a*.

4. When γ is an obtuse angle, say 3π/4 (corresponding to 135 degrees), then the design circumference given by equation (8) is $2\pi r+3\pi r/4=11/8(2\pi r)$. Again, this can be expressed as $2\pi r+\frac{1}{4}(2\pi r)+\frac{1}{8}(2\pi r)$, where the last term represents the length of an orthogonal optimized arc that must be "added" to fit an outside corner with a 135 degree angle. This is indicated by the term "arc to be added" in FIG. 7*b*.

It will be seen therefore that the generalized equation for the design circumference of an outside corner patch can be used to optimize a patch to fit near perfectly to an outside corner having one angle that can vary between 0 degrees and 180 degrees.

Figure 8:
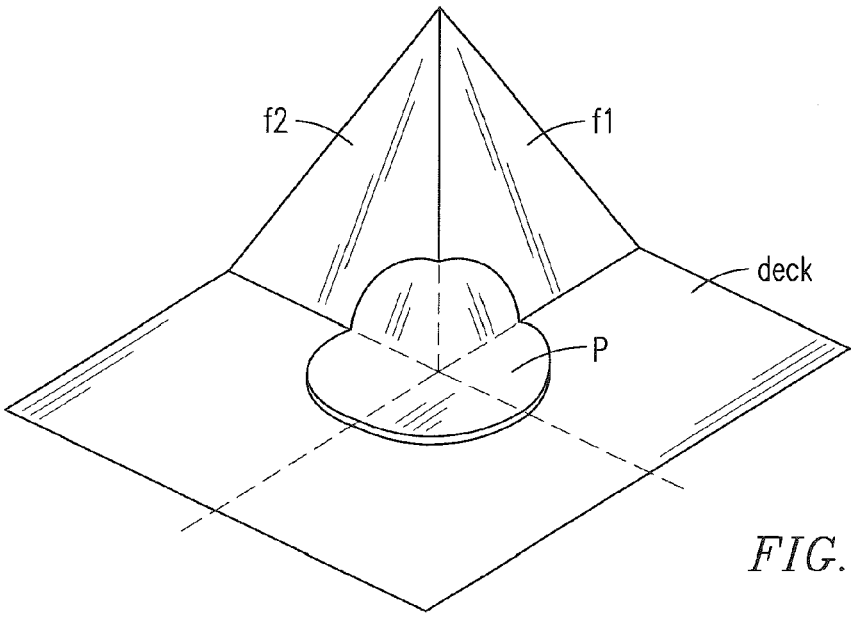
FIG. 8 illustrates an outside corner patch applied to a roof protrusion having two faces that are non-orthogonal with respect to the roof plane.

What about the case where more than one face of a roof protrusion is non-orthogonal with respect to the plane of the roof? Such a protrusion is illustrated in FIG. 8 wherein both faces f1 and f2 are seen to extend upwardly from a roof deck at an acute angle less than π/2 (90 degrees). This will be referred to herein as a "pyramid protrusion." An outside corner patch can be designed for such a pyramid protrusion with a further refinement of the equation for the design circumference, as described below.

Figure 9:
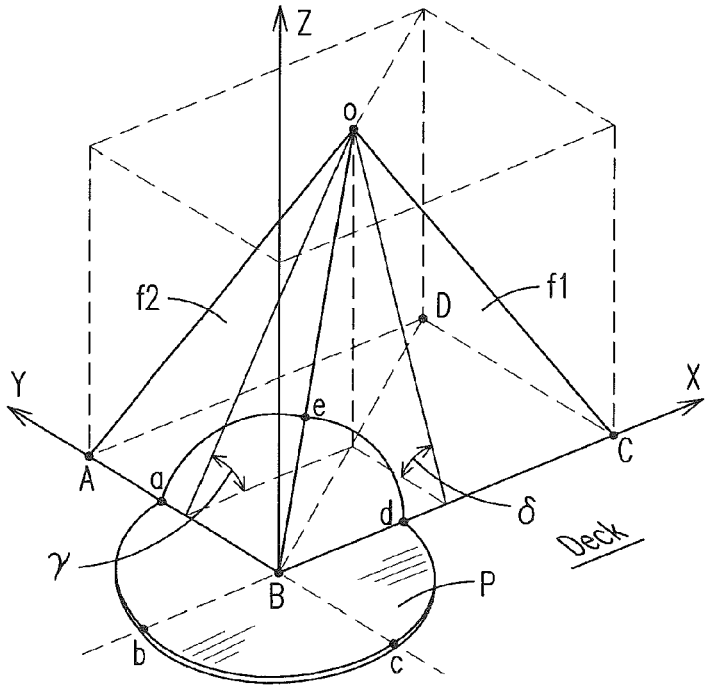
FIG. 9 is a geometric construction illustrating the variables involved when designing an outside corner patch for a protrusion having two non-orthogonal faces.

Referring to FIG. 9, the geometry of the pyramid protrusion is illustrated in three dimensional space defined by axes X, Y, and Z. The pyramid protrusion has face f1 that defines an acute angle δ with respect to the roof deck and face f2 that defines an angle γ with respect to the roof deck. An outside corner patch P is shown in flattened configuration conforming to the faces of the pyramid protrusion with points a, b, c, d, and e defined on the circumference of the patch at strategic locations. Points A, B, C, D, and O also are defined in the illustration of FIG. 9. The design circumference S for outside corner patch is again equal to ab+bc+cd+de+ea. For the geometry of the pyramid corner, this equation becomes:

$$S=\pi r/2+\pi r/2+\pi r/2+\delta r+\gamma r \quad (9)$$

where δ is the angle in radians formed by triangle OBC with respect to the XY plane and γ is the angle in radians formed by the triangle OAB with respect to the XY plane. With angles γ and δ defined for a particular non-orthogonal outside corner (or orthogonal corner for that matter), then the design circumference S can be calculated and subjected to the optimization methodology described above to design an outside corner patch with the proper number of flutes and the proper plunge circle so that when the patch is flattened, it will fit the outside corner of the pyramid protrusion near perfectly. As an example, assume that both faces of a pyramid protrusion form an angle of π/4 (45 degrees) with respect to the roof deck. Then, using equation 9, the design circumference can be calculated as follows:

$$S=\pi r/2+\pi r/2+\pi r/2+\pi r/4+\pi r/4$$

$$S=3/2(\pi r)+\tfrac{1}{2}(\pi r)$$

$$S=4/2(\pi r)=2\pi r$$

Of course, the more generalized equation (9) should reduce to equation (8) in the case of a single face that is angled with respect to the roof deck and to equation (6) in the case of an orthogonal outside corner, which we see that it does:

Where $\delta=\pi/2$ (90 degrees) and $\gamma=\pi/4$ (45 degrees), then equation (9) becomes:

$$S=\pi r/2+\pi r/2+\pi r/2+\pi r/2+\pi r/4$$

$$S=4\pi r/2+\pi r/4$$

$$S=8/4(\pi r)+\tfrac{1}{4}(\pi r)=9/4(\pi r)=9/8(2\pi r)$$

which is the result in example 3 above. Similarly, if both γ and δ are π/2 (90 degrees), then equation (9) should reduce to equation (6) for the case of an orthogonal outside corner, which we see that it does:

$$S=\pi r/2+\pi r/2+\pi r/2+\pi r/2+\pi r/2$$

$$S=5/2\pi r=5/4(2\pi r)$$

Figure 10A:
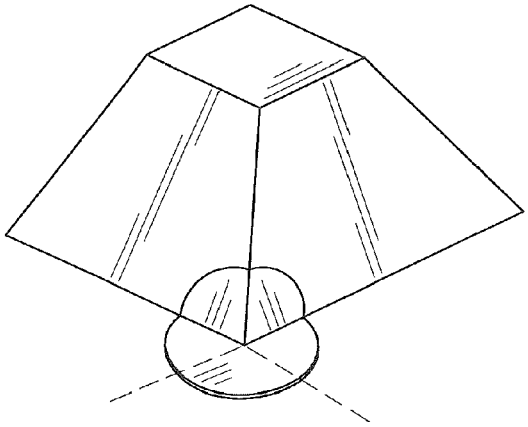
FIGS. 10*a* and 10*b* illustrate outside corner patches fitting corners of acute angled pyramid corners and obtuse angle pyramid corners.
Figure 10B:
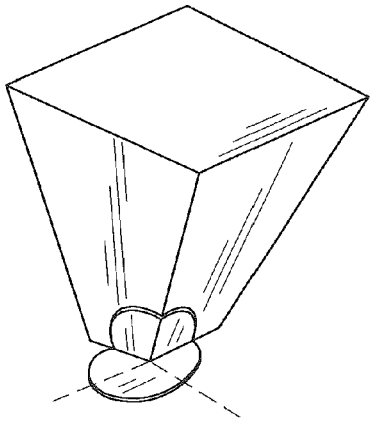

As with equation 8, the more generalized equation 9 works with acute angles and obtuse angles as illustrated in FIGS. 10*a* and 10*b*. Again, once the design circumference is determined for any configuration of outside corner, then the optimization methodology described above is carried out with the determined design conference to reveal a daisy wheel corner patch that, when flattened, will fit near perfectly to the corner.

Figure 11A:
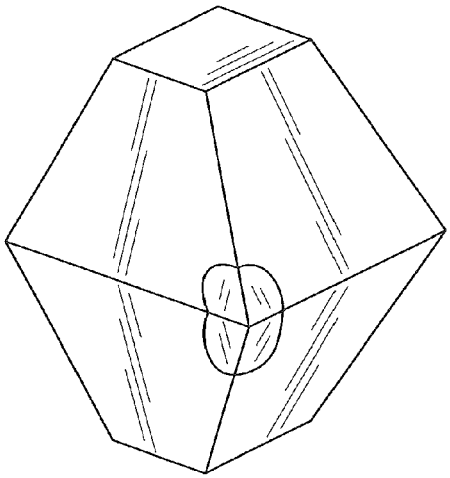
FIGS. 11*a* and 11*b* illustrate application of the methodology of this invention to design corner patches for outside corners having four intersecting sides that each form non-orthogonal angles with respect to each other.
Figure 11B:
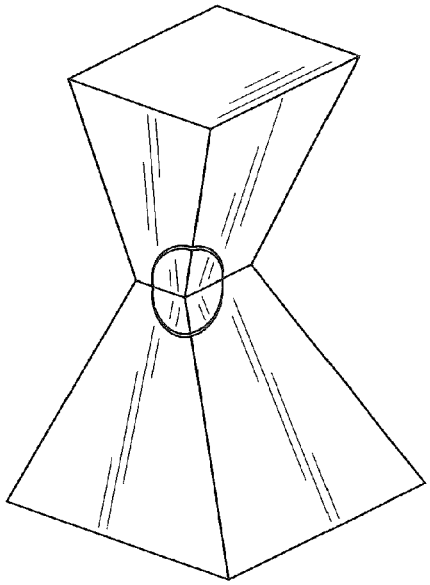

FIGS. 11*a* and 11*b* illustrate application of the methodology of the present invention for designing outside corner patches for corners formed by intersecting non-planar faces. For such cases, calculation of the design circumference is done in a similar manner as that described above, except more than two angles are variable in the general equation for S.

Figure 12A:
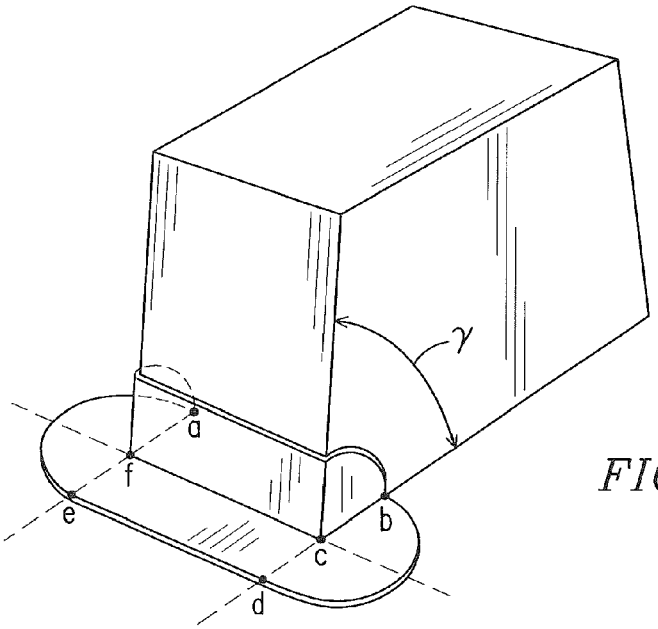
FIGS. 12*a*, 12*b*, and 12*c* illustrate the invention in an alternate embodiment where fluted sections are formed at the ends of an elongated strip of TPO material for sealing a seam of a protrusion and the corners at the ends of the seam with a single patch.
Figure 12B:
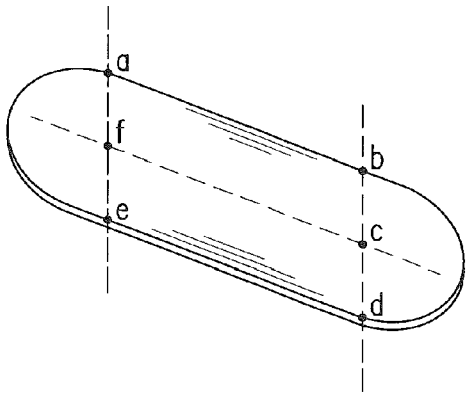
Figure 12C:
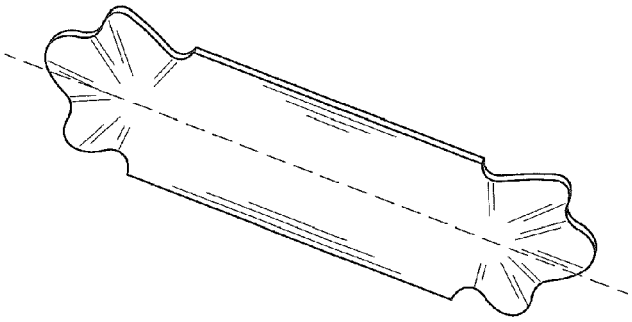

FIGS. 12*a*, 12*b*, and 12*c* illustrate another variation of the invention comprising a rectangular strip of TPO or other roofing membrane of length L fluted at its ends. As shown in FIG. 12*a*, this embodiment of the invention is suited for situations where the length L of a side of a roof protrusion is known in advance and the angle γ that the protrusion makes with the roof deck also is known. The design conference is determined for the outside corner defining angle γ as described above. The optimization methodology is then carried out to determine the optimum number of flutes and the optimum plunge circle radius as described. However, after optimization, the flutes are separated equally and formed on the semicircular ends of the elongated blank illustrated in FIG. 12*b*. The result is an elongated patch designed to seal both the straight seam and the corners formed by a protrusion on the roof of a commercial (or residential) building.

Figure 13:
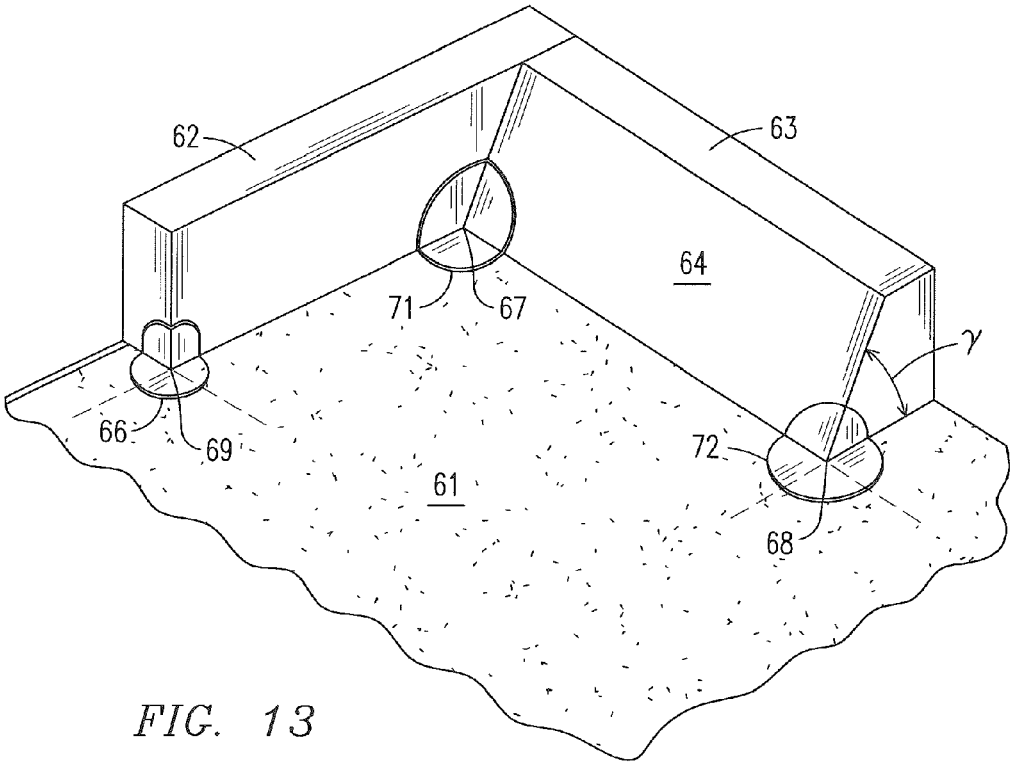
FIG. 13 illustrates a section of a commercial roof having a roof deck, a rectangular wall, and a parapet wall, the corners of which are sealed with various corner patches according to the invention.

FIG. 13 illustrates a section of a roof with various types of corners sealed with corner patches according to the invention. The roof has a deck 61 sealed with a membrane according to known techniques. A rectangular wall 62 extends along one side of the roof and a parapet wall 63 extends along an adjacent side of the roof to meet the rectangular wall at a corner of the roof. The parapet wall 63 is characterized by an angled inside face 64 that extends down to the deck of the roof 61. The rectangular wall forms an orthogonal outside corner 69 at its end and the parapet wall 63 forms a wedge shaped outside corner 68 at its end. The orthogonal outside corner 69 is sealed with an outside corner patch 66 optimized for an orthogonal outside corner according the first disclosed embodiment described above (which also could have been designed using the equation of FIG. 9 with both angles set to π/2). The wedge-shaped outside corner 68 is sealed with a generalized outside corner patch according to the second disclosed embodiment above (which also could have been designed by the third embodiment with one angle equal to π/2).

Figure 14A:
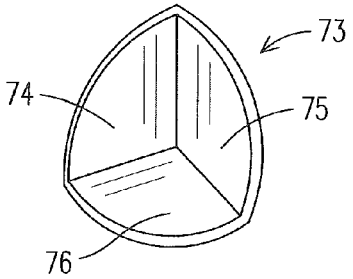
FIGS. 14*a* and 14*b* illustrate an inside corner patch according to the invention for sealing an inside corner on a TPO or other membrane based roof.
Figure 14B:
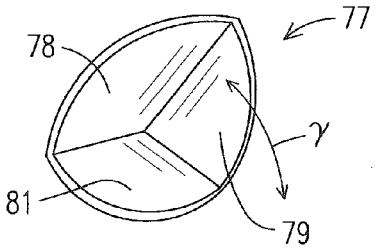

The inside corner 67 formed by the junction of the rectangular wall 62 and the parapet wall 63 is sealed by an inside corner patch71 according to the invention. The inside corner patch is molded or otherwise formed with three faces, to of which are orthogonal to cover the roof deck and part of the face of the rectangular wall and the third of which is angled at an angle γ so that it fits snuggle against the angle wall 64 of the parapet wall. Such inside corner patches may be pre-molded from TPO or other membrane material with various angles fixed into the patch to conform to inside corners of various angles and configurations. For example, FIG. 14*a* illustrates an inside corner patch 73 for an orthogonal inside corner having faces 74, 75, and 76 that are mutually orthogonal. FIG. 14*b* illustrates an inside corner patch 77 having orthogonal faces 78 and 81 and face 79 that forms an angle γ with respect to face 81. This is the type of patch seen on the inside corner in FIG. 13. Of course, inside corner patches can be molded or formed with all of its faces non-orthogonal to accommodate unusual inside corners on commercial or residential roofs. Inside corner patches do not require optimization as do outside corner patches since each is configured for a correspondingly shaped inside corner The invention has been described herein in terms of preferred embodiments and methodologies considered by the inventors to represent the best mode of carrying out the invention. However, numerous additions, deletions, and modifications of the illustrated embodiments might be made by those of skill in the art without departing from the spirit and scope of the invention as set forth in the claims. For example, the patch has been described within the context of flat commercial roofing. However, the invention is not limited to flat roofs or commercial roofing but may be adapted for sealing corner protrusions in non-flat roofs. Indeed, the invention may be applied in non-roofing scenarios such as in sheet metal structures, tub and shower basins, and the like where it is desired to seal outside corners of protrusions.

What is claimed is:

1. A corner patch for conforming to and covering a corner formed by a protrusion from a roof deck, the protrusion having a first face projection upwardly at an angle δ in radians with respect to the roof deck and a second face contiguous with the first face and projecting upwardly at an angle γ in radians with respect to the roof deck, the corner patch being made of a flexible material and comprising a body formed from a substantially circular blank having a radius $r_b$ and a central region, and a number n of substantially conical-section-shaped flutes formed in a radiating outwardly from the central region, the number n and the sizes of the flutes are optimized such that when the corner patch is flattened, it conforms to the corner when the corner patch is applied thereto, each flute has a shape defined by a plunge circle located at a periphery of the corner patch and establishing a flute draw h, and wherein n and h for a given $r_b$ substantially satisfy the equation $n\beta r_p \approx \pi r_b/2+\pi r_b/2+\pi r_b/2+\delta r_b+\gamma r_b$ where:

β is the flute depth angle, and $r_p$ is the radius of the plunge circle.

2. The corner patch of claim 1 wherein the body is made of a thermoplastic polyolefin membrane.

3. The corner patch of claim 1 wherein δ and γ are selected from the group consisting of and γ are acute; δ is acute and γ is obtuse; δ is obtuse and γ is acute; and δ and γ are obtuse.

4. The corner patch of claim 1 wherein δ and γ are orthogonal.

5. A roof comprising:

a roof deck;

a protrusion projecting upwardly from the roof deck and forming a corner where two contiguous faces of the protrusion meet the roof deck;

a membrane covering the roof deck;

a membrane at least partially covering the protrusion; and a corner patch as claimed in claim 1 covering and sealing the corner.

6. The roof of claim 5 wherein the membranes are made of thermoplastic polyolefin.

7. The roof of claim 6 wherein the corner patch is made of thermoplastic polyolefin.

8. The roof of claim 5 wherein the membranes and the corner patch are bonded to each other to form a substantially watertight seal.

9. The roof of claim 8 wherein the membranes and the corner patch are thermally welded to each other.

10. The roof of claim 9 wherein the membranes and the corner patch are made of a thermoplastic polyolefin material.

11. An elongated patch for conforming to and covering the straight seam and opposing corners formed by a protrusion from a roof deck, the patch comprising a relatively flat central portion having a length corresponding to the length of the straight seam, a first end portion at one end of the relatively flat central portion, the first end portion being substantially one-half of a patch according to claim 1, and a second end portion at the other end of the relatively flat central portion, the second end portion being substantially one-half of a patch according to claim 1, whereby the elongated patch conforms to the straight seam and the opposing corners of the protrusion to seal the protrusion.

12. A method of sealing a corner formed by two contiguous faces of a protrusion from a roof deck, the method comprising the steps of:

(a) determining the angles δ and γ of the two contiguous faces with respect to the roof deck;

(b) obtaining a patch according to claim 1 that has been optimized for the angles δ and γ;

(c) placing the patch at the corner;

(d) flattening the flutes of the patch to conform the patch to the roof deck and the corner; and (e) sealing the patch to the corner.

* * * * *